United States Patent [19]

Kiyosawa

[11] 4,291,928

[45] Sep. 29, 1981

[54] SHOWCASE

[76] Inventor: Kesaomi Kiyosawa, No. 22-1, 2-chome, Minamiaoyama, Minato-ku, Tokyo, Japan

[21] Appl. No.: 100,927

[22] Filed: Dec. 6, 1979

[30] Foreign Application Priority Data

Jul. 23, 1979 [JP] Japan ..... 54-100585[U]

[51] Int. Cl.[3] ..... A47B 43/00; F16B 12/00

[52] U.S. Cl. ..... 312/257 R; 312/257 SK; 312/140; 312/111; 108/107; 211/187; 248/243; 248/250

[58] Field of Search ..... 312/257 R, 257 SK, 257 A, 312/108, 111, 140, 140.1, 138 A; 108/107; 211/187, 208; 52/282; 248/243, 250

[56] References Cited

U.S. PATENT DOCUMENTS

| | | | |
|---|---|---|---|
| Re. 27,186 | 10/1971 | Ferdinand et al. | 108/107 |
| 721,292 | 2/1903 | Forster | 312/111 |
| 984,006 | 2/1911 | Kade | 312/140 |
| 2,598,957 | 6/1952 | Wolfe | 312/257 R |
| 2,765,886 | 10/1956 | Tedaldi et al. | 312/140 |
| 2,909,289 | 10/1959 | Laurie | 108/107 |
| 3,087,768 | 4/1963 | Anderson et al. | 312/257 R |
| 3,182,846 | 5/1965 | Lakaff | 312/140 |
| 3,469,711 | 9/1969 | Swaneck et al. | 312/138 A |
| 3,786,765 | 1/1974 | Burr | 312/108 |
| 4,126,364 | 11/1978 | Reilly | 312/140 |

*Primary Examiner*—Victor N. Sakran
*Attorney, Agent, or Firm*—Fleit & Jacobson

[57] ABSTRACT

This invention relates to a showcase for displaying the commodities used in shops, department stores, etc. More particularly, it relates to a showcase comprising: tube shaped shelf pillars having a plurality of bored holes in a longitudinal direction of an inner wall surface; corner sashes for receiving the shelf pillars, to which glass plates are attached at their sides, the corner sashes respectively covering the circumferences of the shelf pillars; horizontal tubes; joint mechanisms connecting each shelf pillar to each horizontal tube; and shelf assemblies structured with a hook at each end engageable with a hole of the shelf pillar.

5 Claims, 6 Drawing Figures

SHOWCASE

BACKGROUND OF THE INVENTION

In the conventional showcase, it is not only difficult to construct it simply, but also difficult to break it up when once constructed. Further, it does not look nice because the pillar at each corner is protruded at acute angle, and each shelf structured within the case can not be moved to an arbitary height because it is fixed. Furthermore, this shelf disturbs the commodity exhibition when commodities are shown because a frame which structures the shelf is provided along the glass of the case, and customers who peep into the showcase are also disturbed by this shelf.

This invention is a novel technique which amends these conventional defects.

DETAILED DESCRIPTION OF THE DRAWING

Figure 1:
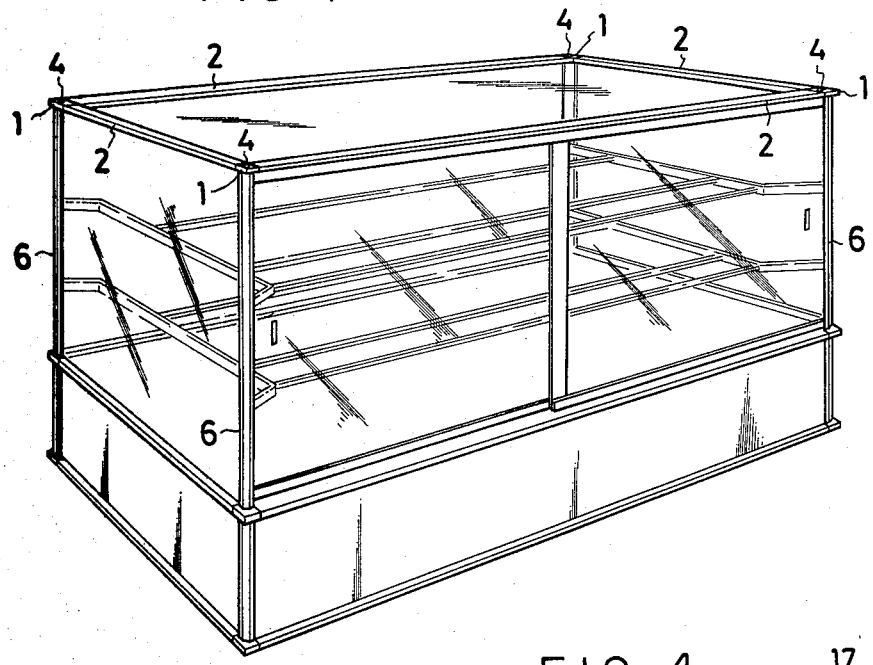
FIG. 1 is a perspective view of a whole construction after the completion of the construction.
Figure 2:
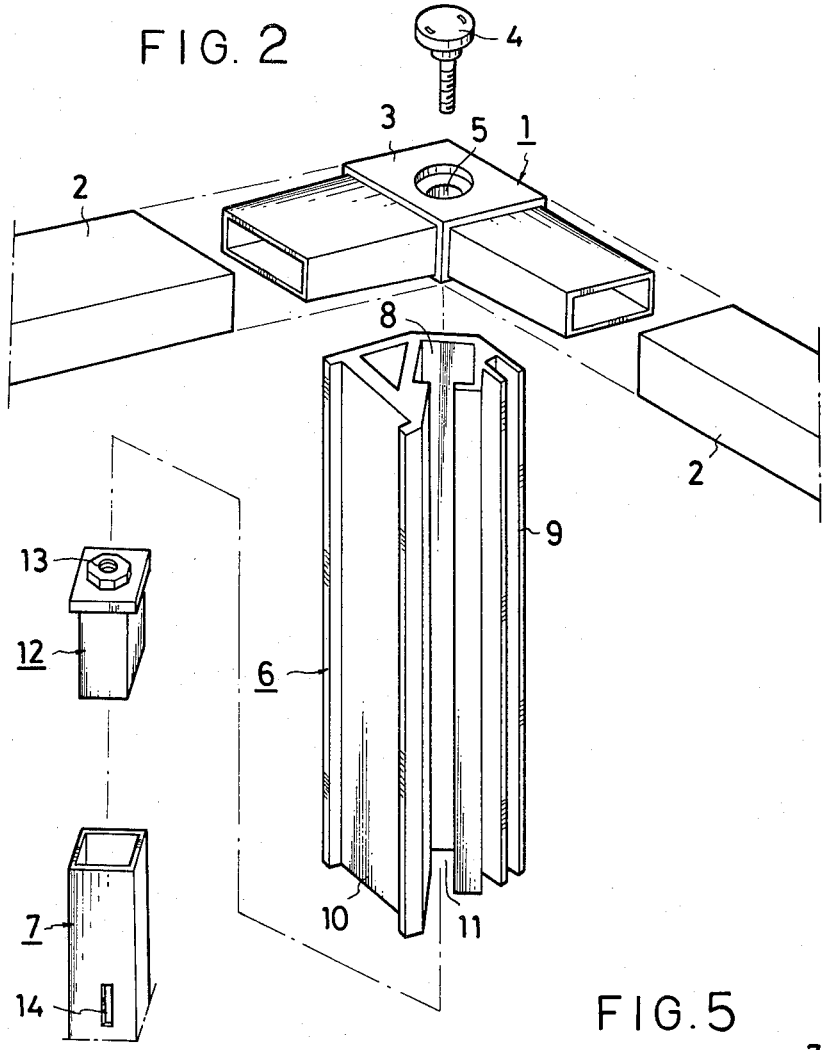
FIG. 2 is an exploded view of the structural parts in the frame of showcase.
Figure 5:
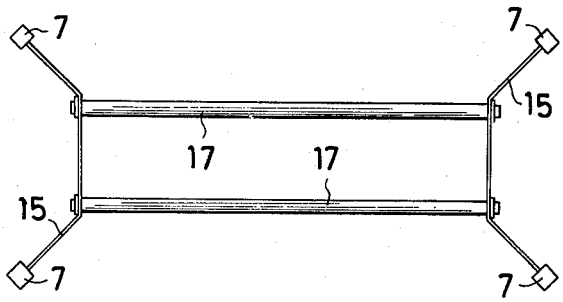
FIG. 5 and FIG. 6 are top views of the shelf means.

In FIG. 1 and FIG. 2, the numeral 1 is a coupling which can connect two horizontal tubes 2 at right angles to each other. The base portion 3 of the coupling 1 has a bored bolt hole 5 which can receive a bolt 4 therethrough. The numeral 2 is a horizontal tube which can form a horizontal portion of the frame in the showcase. The numeral 7 is a shelf pillar composed of square pipes, at the inner surface of which a plurality of shelf receiving holes 14 are bored therethrough. The numeral 12 is a connecting member which can be inserted into the upper end of the shelf pillar 7, at the upper end of which a nut 13 is provided for engagement with said bolt 4. Accordingly, it is possible to construct said two horizontal tubes 2 and one core member tube 7 respectively with the joint means composed of coupling 1, bolt 4 and connecting member 12. The numeral 6 is a corner sash, the central portion of which is pierced vertically by a longitudinal hole 8 so that it is possible to insert said shelf pillars 6 therethrough. Further, the inner surface of said sash 10 is bored vertically by a connecting groove 11 connected with the longitudinal hole 8. Furthermore, on both sides of the sash, arms 10 which can receive the end of a glass plate therein or arms 9 which can receive the end of a sliding door are integrally protruded respectively.

Figure 4:
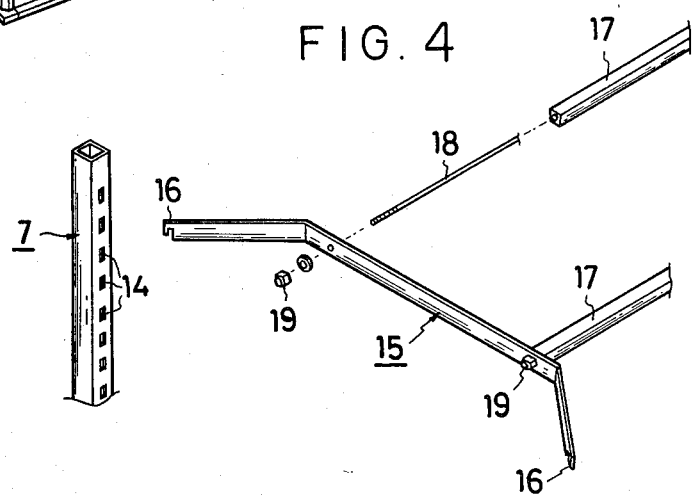
FIG. 4 is an exploded view of the shelf construction.
Figure 3:
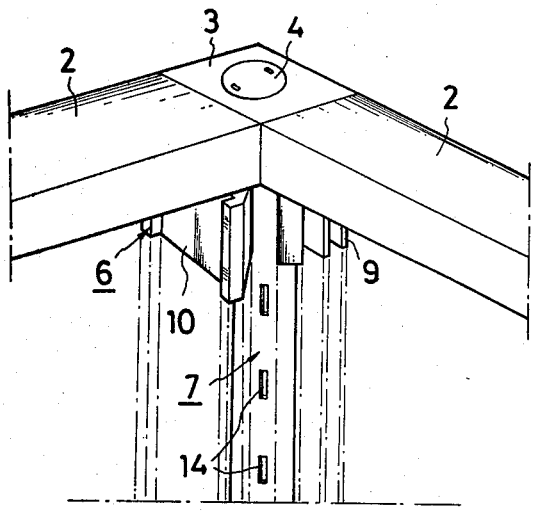
FIG. 3 is a perspective view of the structural parts of the frame.
Figure 6:
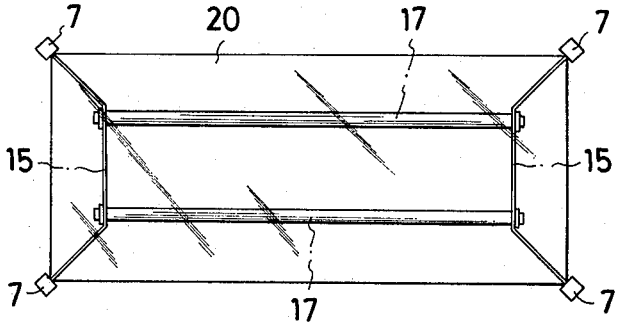

Then, in FIG. 4, and FIG. 6, the numeral 15 is a supporting bar of the shelf means having a straight central portion and end portions bending at 45°. Protruded at both ends are hooks 16 which can be inserted into the shelf receiving hole 14 of the shelf pillar 7. Further, at both ends of the straight line portion round holes are bored. The numberal 17 is a connecting tube which connects said two supporting bars 15 and the numeral 18 is a shaft which can be inserted through the connecting tube, at both ends of which threaded portion are provided. The numeral 19 is a nut engaged with the threaded portion of the shaft 18.

In construction of the case according to this invention, as shown in FIGS. 1, 4, 5 and 6, the shelf pillar 7 is inserted into the longitudinal hole 8 of the sash 6; the horizontal tube 2 is connected with the shelf pillar 7 by the joint means composed of the coupling 1, bolt 4, and the connecting member 12, thereby structuring the frame of the case. On the other hand, the whole showcase is constructed by: structuring the shelf means connecting the connecting tube 17 with the supporting bar 15 through the shaft 18 and the nut, 19, then mounting the glass shelf plate 20 thereon; structuring the shelf inside the frame by inserting the hook 16 of the supporting bar 15 into the shelf supporting hole 14 of the shelf pillar 7; and attaching the side glass plate and the sliding door to the frame.

Since the showcase according to this invention can be structured by constructing the numerous parts in order, even the amateur can simply construct in the field or break it up easily in case of unnecessity. Further, since the shelf pillar is housed within the corner sash, the corner portion of the case has depth and looks nice without any protrusion of the surface toward outside. Since the supporting bar and the connecting tube of the shelf means are constructed at the central portion inside the case and the glass shelf plate is mounted thereon, said shelf means does not disturb the customer in case of showing the commodities or viewing the case.

Further, the shelf within the case can be moved up and down freely in accordance with the position of the shelf receiving hole of the shelf pillar.

I claim:

1. A showcase comprising:

a plurality of longitudinally-extending shelf pillars (7), each shelf pillar having a plurality of longitudinally spaced shelf receiving openings (14) formed therein;

a plurality of longitudinally-extending corner sashes (6), each corner sash having a central passageway (8) defined therein for receiving a shelf pillar and a longitudinally-extending slot (11) providing access to the openings in the shelf pillar, the corner sash having longitudinally-extending transversely spaced apart arms defining grooves for receiving plates forming sides of the showcase;

a plurality of horizontal tubes (2) positioned to interconnect upper ends of adjacent pairs of corner sashes;

means for interconnecting end portions of said hollow tubes with said corner sashes comprising:

a bolt (4), coupling means (1) having a base portion (3) and protruding portions engageable with end portions of respective ones of said horizontal tubes, said base portion having a through bore (5) formed therein for passage of a shaft of said bolt, and connecting means (12) positioned in an upper portion of a shelf pillar received in a corner sash and having a threaded portion for engaging an end of the shaft of said bolt (4) to thereby connect said coupling means to said connecting means; and shelf support means for supporting a shelf (20) and having protruding portions (16) insertable into selected ones of the openings (14) formed in two adjacent shelf pillars to thereby adjust the vertical position of the shelf with respect to the shelf pillars.

2. A showcase according to claim 1, wherein said self support means comprises:

a pair of connecting tubes (17);

threaded shafts (18) protruding from each end of the connecting tubes;

a pair of supporting bars for holding the connecting tubes spaced from each other, each supporting bar having a straight central portion with spaced apart openings formed therein for receiving respective ones of the threaded shafts, and end portions extending angularly away from the central portion so that the central portion is spaced from sides of the showcase, the ends of the end portions forming the protruding portions (16); and means for holding (19) the threaded shafts in the openings in the supporting bars.

3. A showcase according to claim 1, wherein each of said sashes comprises first and second longitudinally-extending planar surfaces positionable in planes parallel to plates forming sides of the showcase, and a third planar surface interconnecting and extending angularly to the first and second planar surfaces, the third planar surface forming a corner of the showcase.

4. A showcase according to claim 2, wherein said connecting tubes are hollow and said shafts are inserted into and protrude from both ends of said connecting tubes.

5. A shelf assembly for use with a showcase having a plurality of vertically-extending shelf pillars with vertically-spaced shelf receiving openings formed in each of the pillars, said shelf assembly comprising:

a pair of connecting tubes (17);

a threaded shaft (18) extending from each end of each connecting tube;

a pair of supporting bars, each bar having a straight central portion and end portions extending angularly away from the central portion, the central portion having spaced apart openings formed therethrough for receiving respective ones of the threaded shafts so that the connecting tubes are held spaced from each other, the end portions terminating in hooks insertable into one of the openings formed in the pillars to hold the central portion inwardly spaced from the pillars;

means for releasably holding the threaded shafts in the openings in the central portion; and a shelf supported by said connecting tubes and supporting bars.

* * * * *